US007531820B2

(12) United States Patent
Hergenhan et al.

(10) Patent No.: US 7,531,820 B2
(45) Date of Patent: May 12, 2009

(54) ARRANGEMENT AND METHOD FOR THE GENERATION OF EXTREME ULTRAVIOLET RADIATION

(75) Inventors: Guido Hergenhan, Grossloebichau (DE); Christian Ziener, Jena (DE); Juergen Kleinschmidt, Goettingen (DE)

(73) Assignee: Xtreme Technologies GmbH, Jena (DE)

( * ) Notice: Subject to any disclaimer, the term of this patent is extended or adjusted under 35 U.S.C. 154(b) by 501 days.

(21) Appl. No.: 11/426,086

(22) Filed: Jun. 23, 2006

(65) Prior Publication Data

US 2007/0085044 A1 Apr. 19, 2007

(30) Foreign Application Priority Data

Jun. 27, 2005 (DE) ..... 10 2005 030 304

(51) Int. Cl.
*H05G 2/00* (2006.01)

(52) U.S. Cl. ..... 250/504 R; 315/111.21

(58) Field of Classification Search ..... 250/504 R, 250/426; 378/143; 315/111.21
See application file for complete search history.

(56) References Cited

U.S. PATENT DOCUMENTS 6,507,641 B1 1/2003 Kondo et al.
6,677,600 B2 * 1/2004 Ikeuchi ..... 250/504 R
7,302,043 B2 * 11/2007 Bloom et al. ..... 378/143
2007/0228299 A1 * 10/2007 Ziener et al. ..... 250/503.1
2007/0230531 A1 * 10/2007 Hergenhan et al. ..... 372/76
2008/0048134 A1 * 2/2008 Shirai et al. ..... 250/504 R
2008/0180029 A1 * 7/2008 Hergenhan et al. ..... 315/111.21
2008/0258085 A1 * 10/2008 Bauer ..... 250/504 R

FOREIGN PATENT DOCUMENTS

DE 102 19 173 11/2003
EP 1 401 248 3/2004
WO 2005/025280 3/2005

* cited by examiner

*Primary Examiner*—Nikita Wells
*Assistant Examiner*—Johnnie L Smith, II
(74) *Attorney, Agent, or Firm*—Reed Smith LLP

(57) ABSTRACT

The object of an arrangement and a method for the generation of extreme ultraviolet radiation is to construct the radiation source with an increased lifetime of the electrodes for using various emitters, wherein deposits inside the discharge chamber are reduced considerably when using metal emitters. The starting material is supplied as a continuous series of individual volumes which are introduced successively by directed injection and are pre-ionized by a pulsed energy beam. At least the electrode that is thermally loaded to a comparatively greater degree is constructed as a rotating electrode.

26 Claims, 5 Drawing Sheets

ARRANGEMENT AND METHOD FOR THE GENERATION OF EXTREME ULTRAVIOLET RADIATION

CROSS-REFERENCE TO RELATED APPLICATION

This application claims priority of German Application No. 10 2005 030 304.8, filed Jun. 27, 2005, the complete disclosure of which is hereby incorporated by reference.

BACKGROUND OF THE INVENTION a) Field of the Invention

The invention is directed to an arrangement for the generation of extreme ultraviolet radiation containing a discharge chamber which has a discharge area for a gas discharge for forming a radiation-emitting plasma, a first electrode and second electrode, at least the first electrode being rotatably mounted, an energy beam source for supplying an energy beam for the pre-ionization of a starting material serving to generate radiation, and a high-voltage power supply for generating high-voltage pulses for the two electrodes.

The invention is further directed to a method for generating extreme ultraviolet radiation in which a starting material which is pre-ionized by radiation energy is converted by means of pulsed gas discharge into a radiation-emitting plasma in a discharge area of a discharge chamber having the first electrode and second electrode, and at least one of the electrodes in set in rotation.

b) Description of the Related Art

Many radiation sources which rely on different designs and which are based on plasma generated by gas discharge have already been described. The principle common to these devices consists in that a pulsed high-current discharge of greater than 10 kA ignites in a gas of determined density and, as a result of the magnetic forces and the dissipated power, a very hot (kT>20 eV) and dense plasma is generated locally in the ionized gas.

Further developments have been directed, above all, to finding solutions which are distinguished by a high conversion efficiency and a long lifetime of the electrodes.

It has been shown that the radiation outputs which have thus far been inadequate for lithography in extreme violet can apparently only be substantially further increased by efficient emitter substances such as tin or lithium or compounds thereof.

Tin that is supplied in the form of gaseous tin compounds, e.g., as $SnCl_4$ according to DE 102 19 173 A1, has the disadvantage that more emitter material is introduced into the discharge chamber than is necessary for the EUV emission process. As is the case with other metal emitters, leftover residual amounts lead to metal deposits inside the discharge chamber as a result of condensation. In particular, tin layers can form and, when using SnCl4, chlorides can deposit in addition. Operational failure must follow as a matter of course.

WO 2005/025280 A2 discloses a device which is suitable for metal emitters in which rotating electrodes penetrate into a vessel containing molten metal, e.g., tin, the metal applied to the electrode surface is vaporized by laser radiation, and the vapor is ignited by a gas discharge to form a plasma. This device also does not solve the problem of excess supply of emitters.

In stationary electrodes and with repetition rates in the kilohertz range, a surface temperature above the melting temperature of the electrode material, even for tungsten (3650 K), is reached after a few pulses (FIG. 7). However, due to the rotation of the electrode, the equilibrium temperature can be kept low enough that even the temperature peaks on the electrode surface remain below the melting temperature of tungsten (FIG. 8).

But FIG. 8 also shows that the temperature peaks are always far above the melting temperature of tin (505 K) so that, in addition to the laser vaporization, an uncontrolled tin depletion of the electrodes can come about. Due to the proximity of the plasma to the electrodes and the resulting high thermal power densities on the electrodes, erosion of the base material of the electrode cannot be ruled out, which results in a reduced lifetime of the electrodes. The shadowing caused by this is also disadvantageous.

OBJECT AND SUMMARY OF THE INVENTION

Therefore, it is the primary object of the invention to construct the radiation source with an increased lifetime of the electrodes for using various emitters, wherein deposits inside the discharge chamber are reduced considerably when using metal emitters.

According to the invention, this object is met in the arrangement of the type mentioned above for the generation of extreme ultraviolet radiation in that an injection device is directed to the discharge area and supplies a series of individual volumes of the starting material serving to generate radiation and injects them into the discharge area at a distance from the electrodes.

The energy beam supplied by the energy beam source is directed synchronous with respect to time with the frequency of the gas discharge to a location for the generation of plasma that is provided in the discharge area at a distance from the electrodes, the individual volumes arriving at this location where they are pre-ionized in succession by the energy beam.

The injection device is advantageously designed to supply the individual volumes at a repetition frequency that is adapted to the frequency of the gas discharge.

The arrangement according to the invention can be further developed in a particularly advantageous manner in that the first electrode is constructed as a circular disk whose axis of rotation is perpendicular to the circular disk and has a plurality of openings along a circular path concentric to the axis of rotation, which openings pass through the electrode.

In a preferred construction of the invention, the first electrode has a smaller diameter than the second electrode and is embedded extra-axially in the second, stationary electrode. In this construction, the second electrode has an individual outlet opening for the radiation emitted by the plasma, which individual outlet opening is aligned with one of the openings in the first electrode owing to the rotation of the first electrode.

The openings in the first electrode can serve as inlet openings though which the individual volumes arrive in the discharge area. The openings in the first electrode are advantageously conical and taper in direction of the discharge area.

It is also possible to provide the openings in the electrodes as a passage for the residual energy radiation that is not absorbed during the vaporization of the individual volumes. A beam trap arranged downstream in the radiating direction receives this residual radiation.

As an alternative to the construction mentioned above, the second electrode can also be constructed as a circular disk and rigidly connected to the first electrode, and the inlet openings in the first electrode and the outlet openings in the second electrode can have axes of symmetry which are parallel to the axis of rotation and which are aligned with one another.

The first electrode and second electrode can also be mechanically decoupled and can have axes of rotation which are either arranged at an inclination to one another or which extend mutually.

Further, the invention can be constructed in such a way that a vaporization laser, an ion beam source or an electron beam source can be provided as energy beam source.

Further, the above-stated object is met, according to the invention, by a method of the type mentioned above for the generation of extreme ultraviolet radiation in which the starting material is supplied as a continuous series of individual volumes which are introduced into the discharge area by directed injection successively and at a distance from the electrodes and are pre-ionized by a pulsed energy beam.

According to the invention, the individual volumes can be supplied in different ways. In a first variant, the individual volumes can be introduced into the discharge space by a continuous injection, wherein excess individual volumes are separated out before reaching the discharge area, e.g., by means of the rotating electrode. However, the series of individual volumes can also be controlled by the injection device as they are being supplied.

Other advisable and advantageous embodiments and further developments of the arrangement according to the invention and of the method according to the invention are indicated in the subclaims.

By maximizing the distance between the location of plasma generation and the electrodes in combination with the rotation which effectively multiplies the electrode surface, particularly of the electrode that is thermally loaded to a comparatively greater degree, the arrangement and the method according to the invention, by which extreme ultraviolet radiation can be generated through a Z-pinch type gas discharge, ensure not only a long lifetime of the electrodes, but also ensure that deposition of metal can be extensively prevented when using metal emitters within the discharge chamber.

The increased distance is achieved by a step in which the starting material serving as emitter for generating radiation is placed and pre-ionized in a dense state as a droplet or globule at an optimal location for plasma generation. By dense state is meant solid-state density or a density of a few orders of magnitude below solid-state density.

This step also reduces limitations regarding the emitter material itself, so that xenon and tin as well as tin compounds or lithium can also be used.

A gas having a low absorption in the desired wavelength is preferably used as a background gas for the plasma generation. Argon, for example, is particularly suitable. The density of the background gas is geared toward optimizing the point in time of the formation of the plasma at a given discharge voltage and available capacitor capacity.

According to the invention, the optimal quantity of emitters for the desired radiation emission in the EUV wavelength range per discharge pulse is determined by the size of the injected individual volumes virtually without dependence on the background gas density. In this sense, the starting material serving as emitter is supplied in a regenerative and genuinely mass-limited form.

The geometry of the electrodes can be appreciably expanded compared with the use of background gas alone in that the individual volumes are pre-ionized by the energy beam shortly before the discharge, e.g., by laser vaporization, in order to couple the discharge energy into the starting material in an optimal manner.

The supply of fuel in droplet form improves, or even allows for, the use of lithium as emitter material for a Z-pinch discharge because a very high electron density is required for this material. The reason for this is that the desired radiation at 13.5 nm in the case of lithium occurs through the transition from the first excited state to the basic state of the twice-ionized lithium ion Li (2+). However, the excited state is only 22 eV below the ionization level of Li (3+). In order to be able to generate sufficient Li (2+) ions during the gas discharge, the electron density must be very high corresponding to Li (3+)+$e^- \rightarrow$Li(2+). However, the electron densities occurring during pinch discharge with spatially homogeneous gas density are usually too small to achieve adequate conversion efficiencies. On the other hand, the expectancy value in a lithium transfer in droplet form is above 3% and can reach 7%.

The invention will be described more fully in the following with reference to the schematic drawings.

DESCRIPTION OF THE PREFERRED EMBODIMENTS

Figure 1:
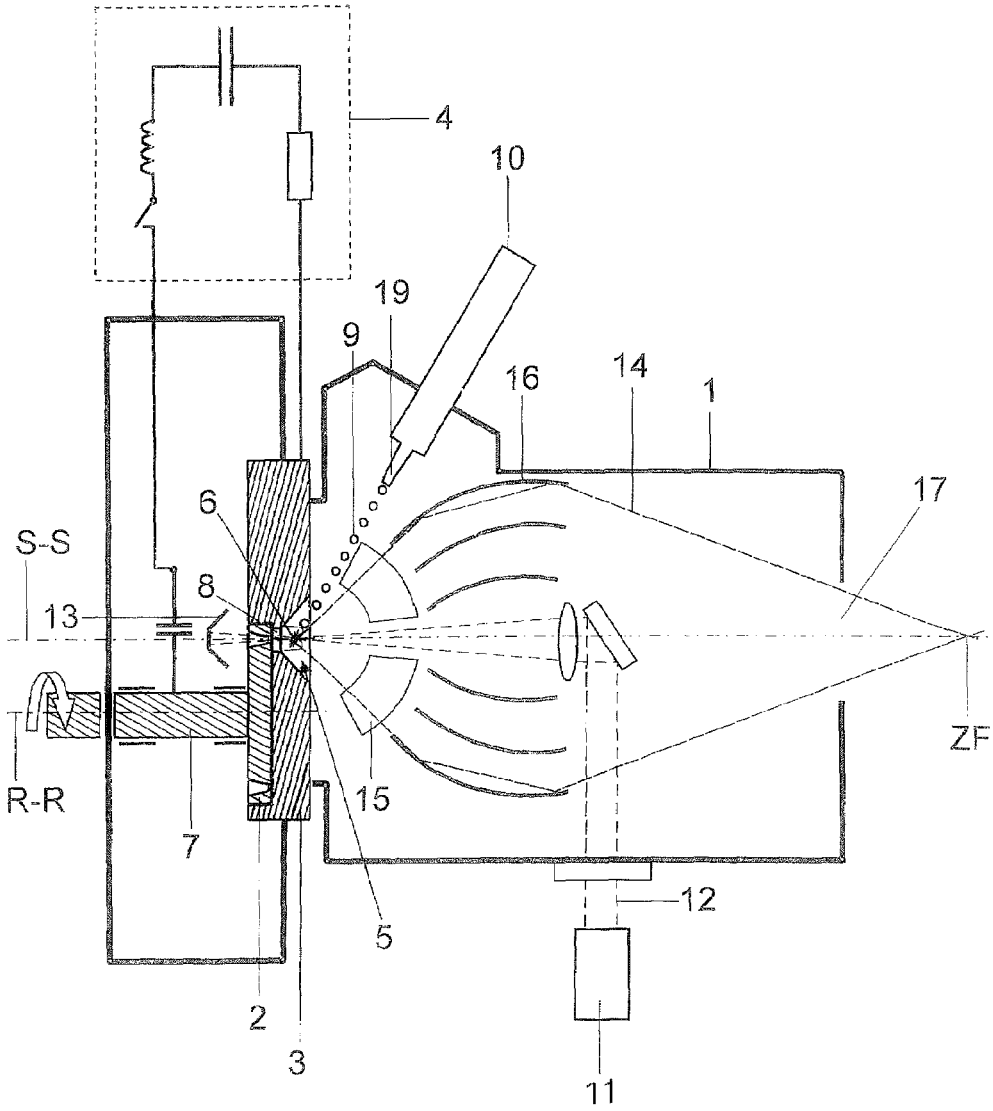
FIG. 1 shows a first construction of a radiation source relying on a gas discharge with laser vaporization of injected individual volumes and an electrode arrangement comprising a stationary electrode and a rotatably mounted electrode.

The radiation source shown in FIG. 1 contains, in an evacuated discharge chamber 1, a first electrode 2 and a second electrode 3 which are electrically connected to a high-voltage pulse generator 4 which, by generating high-voltage pulses with a repetition rate between 1 Hz and 20 kHz and with a sufficient pulse size, ensures that a discharge is ignited in a discharge area filled with a discharge gas and that a high current density is generated which heats pre-ionized emitter material so that radiation of a desired wavelength is emitted by an occurring plasma 6.

Of the electrodes 2, 3 which are constructed as circular disks, the first electrode 2 which is rotatably mounted and formed as a cathode has a smaller diameter than the second, stationary electrode 3 (anode electrode) in which the first electrode 2 is embedded extra-axially so that its axis of rotation R-R is oriented eccentrically parallel to the axis of symmetry S-S of the second electrode 3.

The first electrode 2 is rigidly fastened to a shaft 7 which is received by suitable bearings and whose drive lies outside of the discharge chamber 1.

The two electrodes 2, 3 are insulated from one another so as to prevent electrical breakdown in that there is a distance between them that is so dimensioned that a vacuum insulation prevents a discharge from penetrating through to a desired position of the plasma generation (pinch position). This position lies within the discharge area 5 in the region of an outlet opening 8 that is provided in the second electrode for the generated radiation.

According to the invention, the emitter material is introduced into the discharge area 5 in the form of individual volumes 9, particularly at a location in the discharge area that is provided at a distance from the electrodes 2, 3 and at which the plasma generation is carried out. The individual volumes 9 are preferably supplied as a continuous flow of droplets in dense, i.e., solid or liquid, form through an injection device 10 that is directed to the discharge area 5.

An energy beam 12 which is delivered in a pulsed manner by an energy beam source, preferably a laser beam of a laser radiation source, is directed to the location in the discharge area 5 where plasma is generated so as to be synchronized with respect to time with the frequency of the gas discharge in order to pre-ionize one of the droplets. A beam trap 13 is provided for receiving in its entirety any residual energy radiation that has not been absorbed.

After passing through a debris protection device 15, the radiation 14 emitted by the hot plasma 6 reaches collector optics 16 which direct the radiation 14 to a beam output opening 17 in the discharge chamber 1. By imaging the plasma 6 by means of the collector optics 16, an intermediate focus ZF is generated which is localized in, or in the vicinity of, the beam outlet opening 17 and serves as an interface to exposure optics in a semiconductor exposure installation for which the radiation source that is formed preferably for the EUV wavelength region can be provided.

Figure 2:
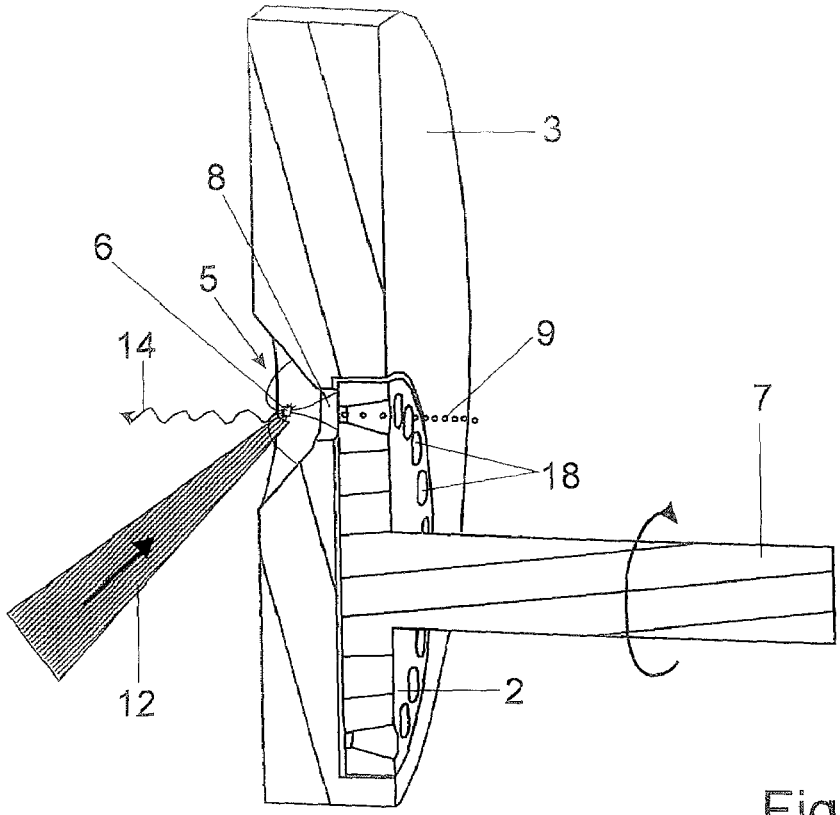
FIG. 2 shows an electrode arrangement with a stationary electrode and a rotatably mounted electrode, wherein the individual volumes are supplied through openings in the rotating electrode.

The first, rotatably mounted electrode 2 contains along a circular path concentric to the axis of rotation R-R a plurality of conical openings 18. Whereas in the construction according to FIG. 1, these openings 18 serve primarily as a passage for the residual energy radiation that is not absorbed, the openings 18 in FIG. 2 are constructed as inlet openings through which the emitter material that is supplied in the form of individual volumes 9 reaches the discharge area 5 when one of the openings 18 is aligned with the outlet opening 8 in the second electrode 3 owing to the rotation of the first electrode 2. The droplet velocity, quantity of openings 18 in the electrode 2, and rate of rotation of the electrodes 2 can be adjusted in such a way that, e.g., only 1 to 3 drops can reach the location of the plasma generation via an opening 18.

The rest of the droplets serve, if necessary, as sacrificial droplets which are vaporized by radiation from the plasmas 6 of preceding discharges and accordingly act as a radiation screen for the droplets which must interact with the energy radiation 12.

Due to the rotation of the first electrode 2, additional droplets bounce off the rotating electrode 2 until the next opening 18 releases the path into the discharge space again. In this way, the individual volumes can be selected from a continuous flow of droplets. The intercepted droplets are thrown outward by centrifugal forces through the conical shape of the openings 18 and can condense on cold surfaces or be pumped out.

In order to protect the injection device 10, particularly its nozzle 9 which produces the droplets, the discharge at repetition frequencies of several kilohertz is advantageously carried out at a time when the position of the rotating first electrode 2 blocks the direct path between the plasma 6 and the nozzle 19.

Owing to the fact that the second electrode 3 is constructed so as to be stationary, this second electrode 3 can be cooled very efficiently by means of channels, not shown, through which cooling liquid flows, if necessary, at high pressure. While this poses a considerable technological challenge for moving parts under high-vacuum, it is nevertheless also applicable for the rotating electrode 2. Cooling ribs on the surfaces of the electrodes or in cavities that are connected to a coolant reservoir via the channels and the introduction of porous material in the cavities can further augment the cooling effect.

Further, it is advantageous that the position of the plasma generation can be kept defined and spatially constant.

Figure 3:
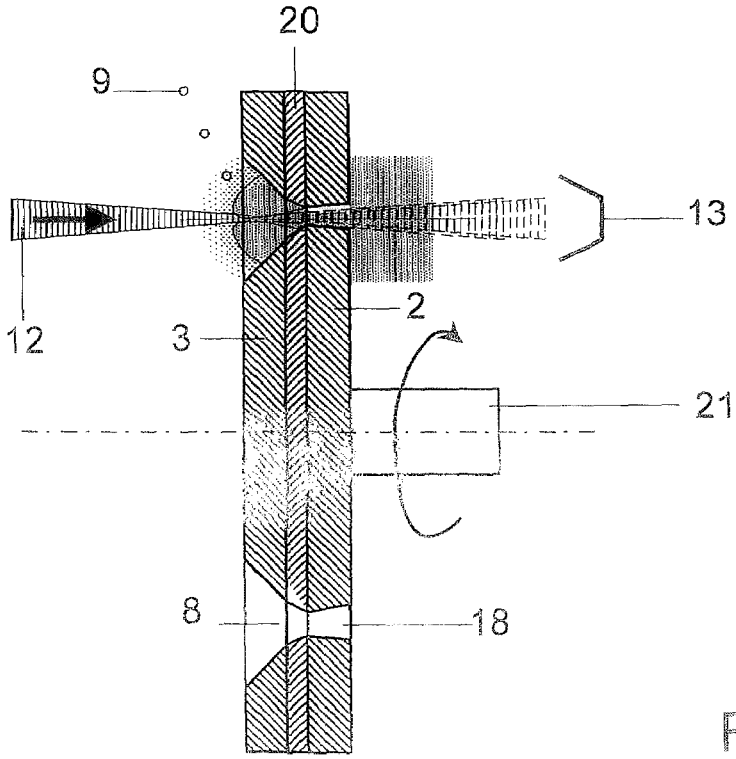
FIG. 3 shows an electrode arrangement in which the two electrodes are rigidly connected to one another and supported so as to be rotatable around a common axis.

In a further development of the invention according to FIG. 3, the two electrodes 2, 3 which are electrically separated from one another by an insulator 20 are rigidly connected via a common rotatably mounted shaft 21 so that the two electrodes 2, 3 can rotate jointly. Suitable insulator materials include $Si_3N_4$, $Al_2O_3$, AlZr, AlTi, BeO, SiC, or sapphire.

The two electrodes 2, 3 have a plurality of conically formed openings 8, 18 which are aligned with one another. As in the construction according to FIG. 1, the individual volumes 9 are directed directly into the discharge space 5.

Based on the drop-on-demand principle, the individual volumes 9 are generated by the injection device 10 already at the desired repetition frequency and velocity, e.g., at the frequency of the discharge or at twice the frequency of the discharge. Techniques known from inkjet technology can also be used for this purpose. At twice the frequency of the discharge, every second individual volume again serves as radiation protection for the individual volume 9 interacting with the energy beam 12.

The openings 8, 18 in the electrodes 2, 3 can also be provided for introducing a background gas into the discharge area 5. A laser beam is likewise used as energy beam 12 in the embodiment example according to FIG. 3. For pre-ionization, this laser beam is directed to a location in the discharge area 5 through which the individual volumes 9 pass.

The portion of the laser beam that is not absorbed by a droplet during ionization is deflected to a beam trap 13 by aligned openings 8, 18 in the electrodes 2, 3 and is absorbed therein without residue. The maximum repetition frequency is determined by the quantity of openings 8, 18 and the rate of revolution of the electrodes 2, 3.

Figure 4:
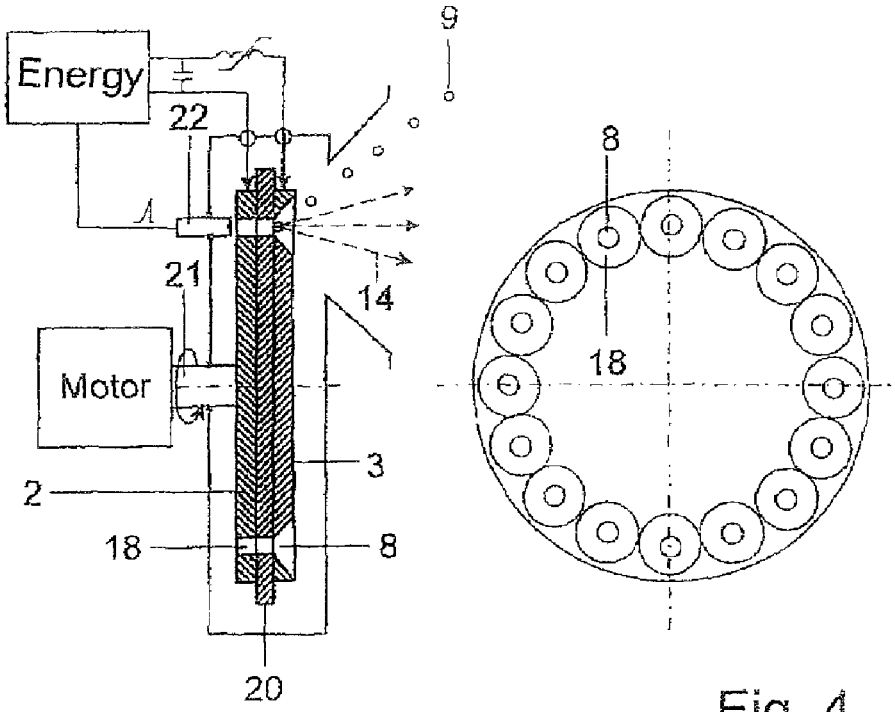
FIG. 4 shows an electrode arrangement according to FIG. 3 with an energy beam source which supplies an ion beam or electron beam for ionization of the individual volumes.

As in FIG. 3, an electrode arrangement with electrodes 2, 3 which are rigidly connected via a common rotatably mounted shaft 21 is used in the radiation source shown in FIG. 4. FIG. 4 differs from FIG. 3 in that, instead of a laser beam, an electron beam supplied by an electron beam source 22 serves as energy beam for pre-ionization of the individual volumes 9 and is radiated through aligned openings 8, 18 rather than directly into the discharge area 5.

In another embodiment form, not shown, an ion beam can serve as energy beam instead of the electron beam.

Since both electrodes 2, 3 rotate jointly during operation in the constructions shown in FIGS. 3 and 4, the process of plasma generation takes place with discrete rotational positions of the electrodes 2, 3.

Finally, the two electrodes 2, 3 can also have axes of rotation R'-R', R"-R' arranged at an inclination relative to one anther. It is not important whether or not the two electrodes 2, 3 are mechanically coupled. The same applies for the orientation of their axes of rotation and the rotating direction.

The geometry of the electrodes 2, 3 must be carried out in such a way that the density and conductivity of the background gas at the location of plasma generation are so influenced by the energy beam 12 directed to the individual volumes 9 that the conditions for a breakdown of the gas discharge according to the Paschen curve are met only at this location.

Figure 5:
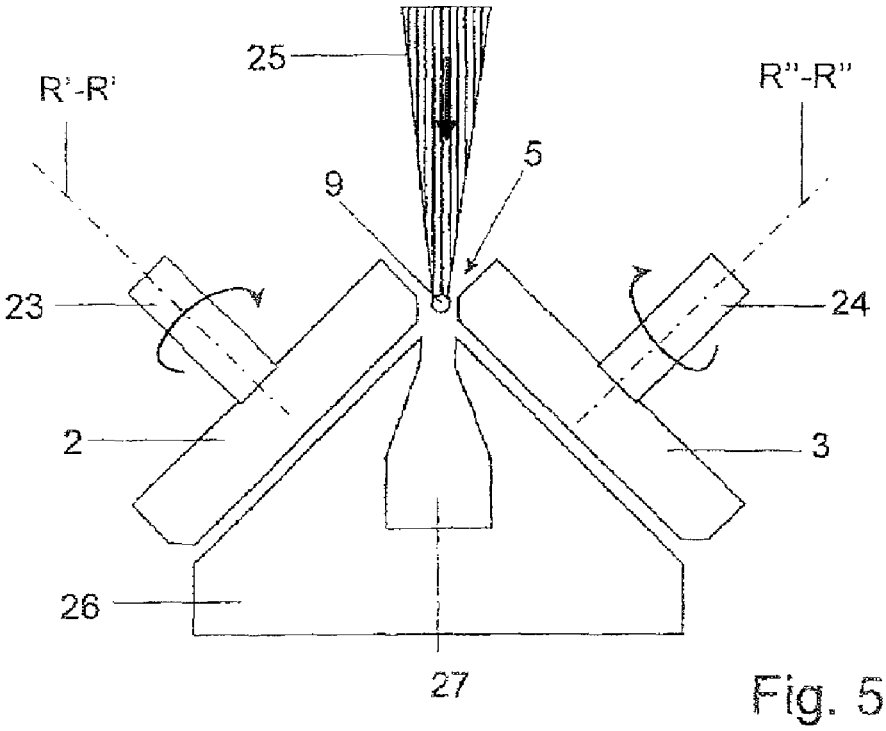
FIG. 5 shows a first construction of an electrode arrangement with mechanically decoupled electrodes.

The construction according to FIG. 5 provides electrodes 2, 3 which are not mechanically coupled and which are rigidly connected to rotatably mounted shafts 23, 24. In the discharge area 5 in which the two electrodes 2, 3 are located opposite to one another at a slight distance, a locally high density of pre-ionized emitter material is generated by the bombardment of a droplet-shaped individual volume 9 by a laser beam 25 before the discharge is initiated. A beam trap 27 for residual laser radiation that is not absorbed is incorporated in an insulator block 26 which is provided between the electrodes 2, 3 that are arranged at an inclination relative to one another.

Figure 6:
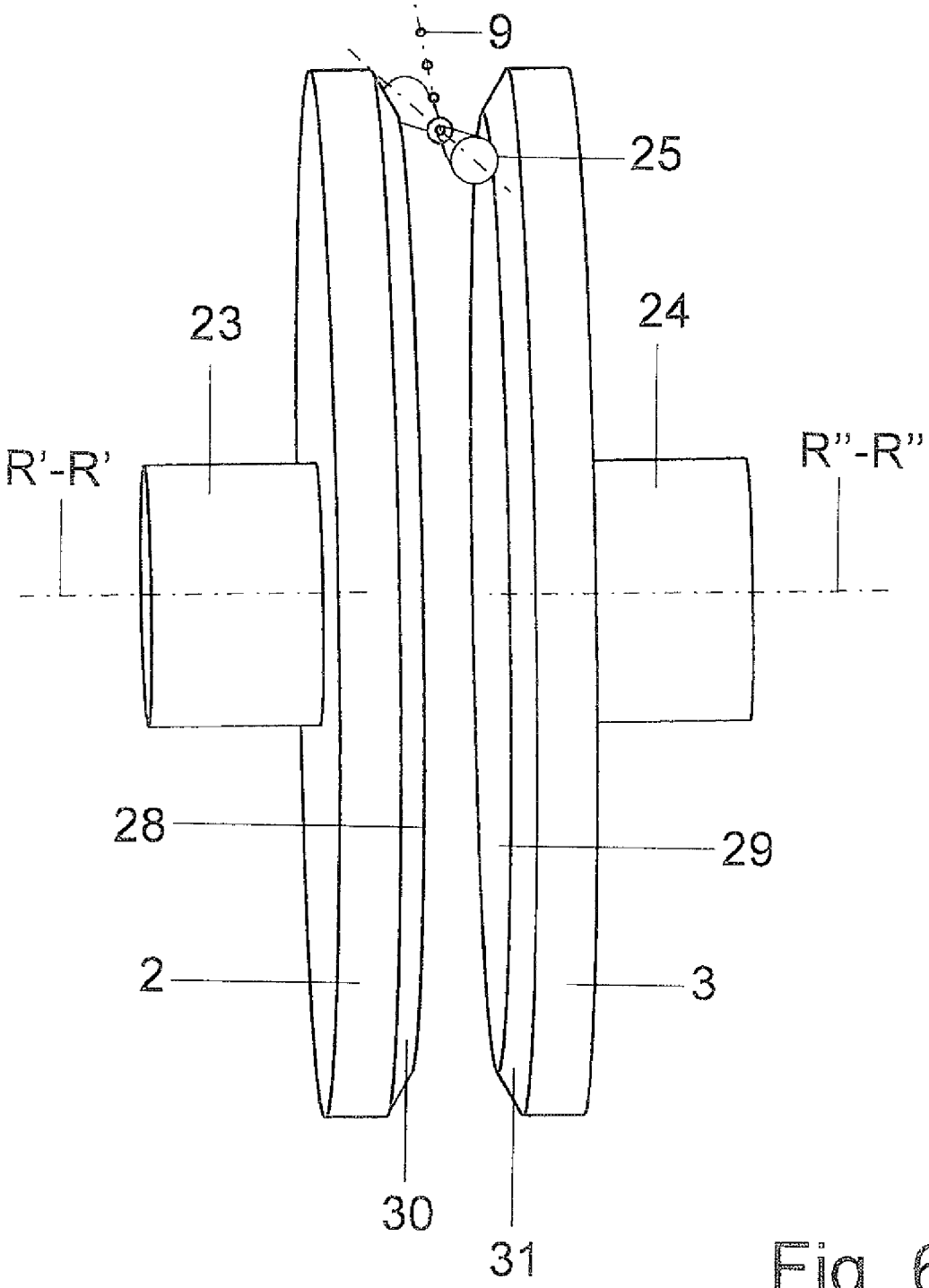
FIG. 6 shows a second construction of an electrode arrangement with mechanically decoupled electrodes.
Figure 7:
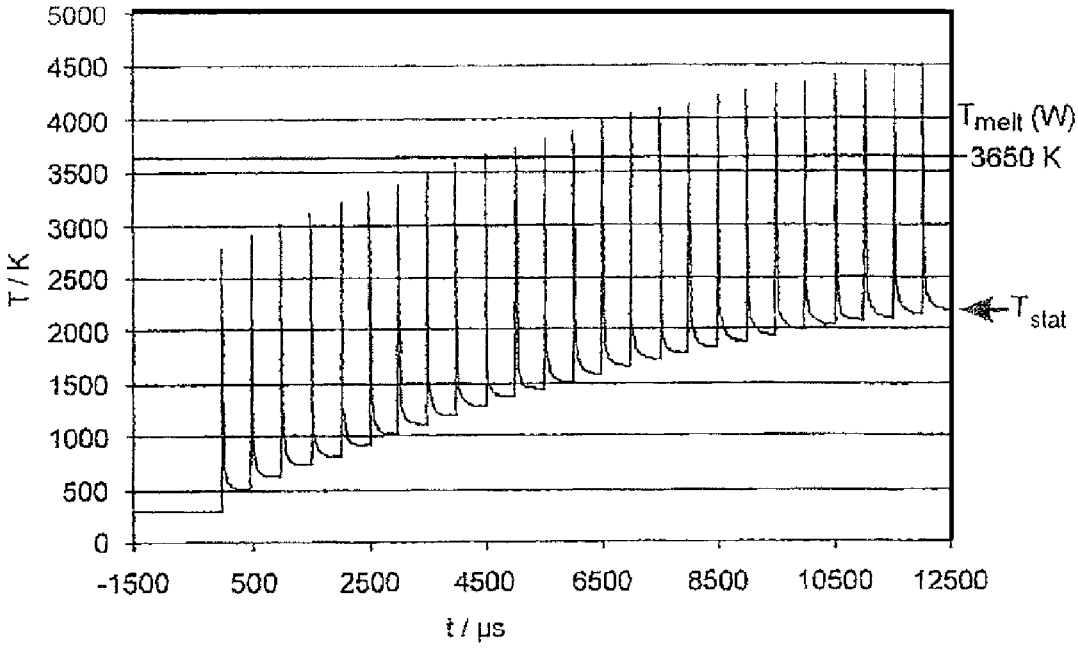
FIG. 7 shows the development over time of the temperature on the electrode surface in an electrode system with stationary electrodes starting from the switch-on time.
Figure 8:
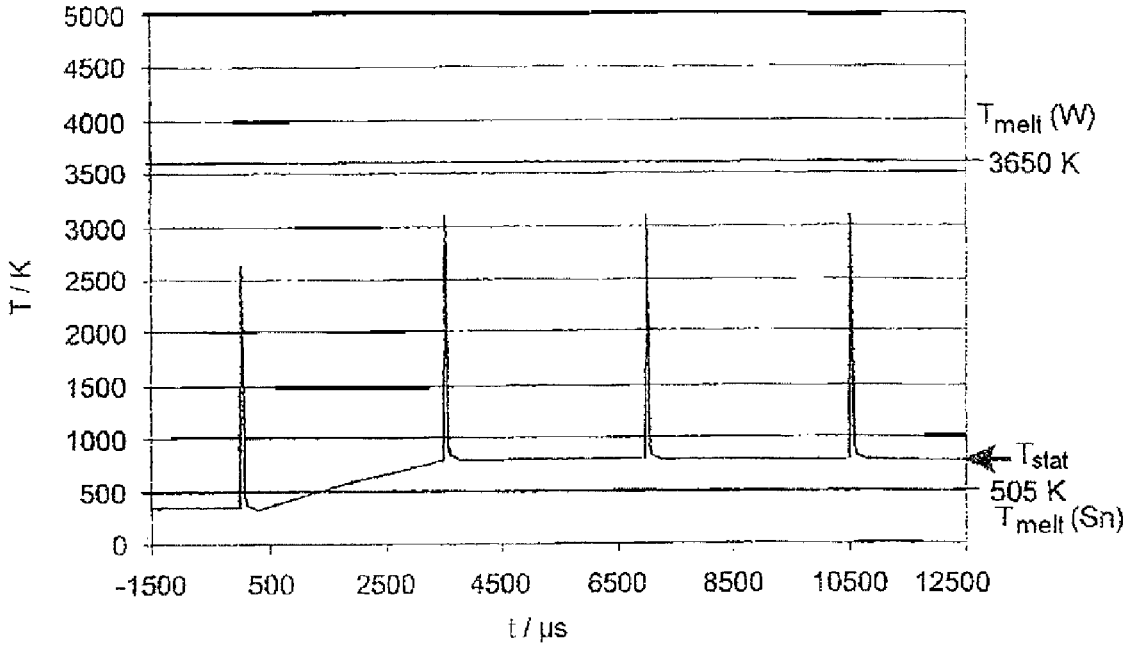
FIG. 8 shows the development over time of the temperature on the electrode surface of a rotating electrode relative to the melting temperature of tungsten and tin.

In another construction according to FIG. 6, the two electrodes 2, 3 which are formed as plates are also mechanically decoupled but, in contrast to FIG. 5, in such a way that the rotatably mounted shafts 23, 24 have mutually extending axes of rotation (R'-R', R"-R"). Consequently, the electrodes 2, 3 are at a distance from one another with surfaces 28, 29 facing one another.

While the foregoing description and drawings represent the present invention, it will be obvious to those skilled in the art that various changes may be made therein without departing from the true spirit and scope of the present invention.

What is claimed is:

1. An arrangement for the generation of extreme ultraviolet radiation comprising:

a discharge chamber which has a discharge area for a gas discharge for forming a radiation-emitting plasma;

a first electrode and second electrode, wherein at least the first electrode is rotatably mounted;

an energy beam source for supplying an energy beam for the pre-ionization of a starting material serving to generate radiation;

a high-voltage power supply for generating high-voltage pulses for the two electrodes; and an injection device being directed to the discharge area and supplying a series of individual volumes of the starting material serving to generate radiation and injecting them into the discharge area at a distance from the electrodes.

2. The arrangement according to claim 1, wherein the energy beam supplied by the energy beam source is directed so as to be synchronous with respect to time with the frequency of the gas discharge to a location for the generation of plasma that is provided in the discharge area at a distance from the electrodes, the individual volumes arriving at this location where they are pre-ionized in succession by the energy beam.

3. The arrangement according to claim 2, wherein the injection device is designed to supply the individual volumes at a repetition frequency that is adapted to the frequency of the gas discharge.

4. The arrangement according to claim 3, wherein the first electrode is constructed as a circular disk whose axis of rotation is perpendicular to the circular disk and has a plurality of openings along a circular path concentric to the axis of rotation, which openings pass through the electrode.

5. The arrangement according to claim 4, wherein the second electrode is constructed so as to be stationary and has an individual outlet opening for the radiation emitted by the plasma, and one of the openings in the first electrode is aligned with the outlet opening owing to the rotation of the first electrode.

6. The arrangement according to claim 5, wherein the first electrode has a smaller diameter than the second electrode and is embedded extra-axially in the second electrode.

7. The arrangement according to claim 6, wherein the openings in the first electrode are constructed as inlet openings through which the individual volumes arrive in the discharge area.

8. The arrangement according to claim 7, wherein the openings in the first electrode are conical and taper in direction of the discharge area.

9. The arrangement according to claim 7, wherein the openings in the electrodes are provided as a passage for the residual energy radiation that is not absorbed during the pre-ionization of the individual volumes, and wherein a beam trap is arranged downstream in the radiating direction for receiving the residual energy radiation.

10. The arrangement according to claim 9, wherein a vacuum which is provided in the discharge chamber serves as an insulator between the first electrode and second electrode.

11. The arrangement according to claim 4, wherein the second electrode is constructed as a circular disk and is rigidly connected to the first electrode, and in that the inlet openings in the first electrode and the outlet openings in the second electrode have axes of symmetry which are oriented parallel to the axis of rotation and which are aligned with one another.

12. The arrangement according to claim 11, wherein an insulator which is fashioned from insulator materials $Si_3N_4$, $Al_2O_3$, AlZr, AlTi, BeO, SiC, or sapphire is provided between the first electrode and second electrode.

13. The arrangement according to claim 1, wherein the first electrode and second electrode are mechanically decoupled and have axes of rotation which are arranged at an inclination to one another.

14. The arrangement according to claim 1, wherein the first electrode and second electrode are mechanically decoupled and have mutually extending axes of rotation.

15. The arrangement according to claim 1, wherein the electrodes have cavities that are connected to a coolant reservoir by channels.

16. The arrangement according to claim 15, wherein rib structures are provided in the cavities for enlarging the surface.

17. The arrangement according to claim 15, wherein the cavities are filled with porous material.

18. The arrangement according to claim 1, wherein a vaporization laser is provided as energy beam source.

19. The arrangement according to claim 1, wherein an ion beam source is provided as energy beam source.

20. The arrangement according to claim 1, wherein an electron beam source is provided as energy beam source.

21. A method for the generation of extreme ultraviolet radiation wherein a starting material which is pre-ionized by radiation energy is changed into the radiation-emitting plasma in a discharge area of a discharge chamber having a first electrode and a second electrode, and at least one of the electrodes is set in rotation, further comprising the step of supplying the starting material as a continuous series of individual volumes which are introduced into the discharge area by directed injection successively and at a distance from the electrodes and are pre-ionized.

22. The method according to claim 21, wherein the individual volumes are introduced into the discharge space by a continuous injection, and excess individual volumes are separated out before reaching the discharge area.

23. The method according to claim 22, wherein the sequence of individual volumes is controlled by the injection device as they are being supplied.

24. The method according to claim 22, wherein excess individual volumes are separated out by means of the rotating electrode.

25. The method according to claim 21, wherein the individual volumes are pre-ionized by a pulsed energy beam.

26. The method according to claim 21, wherein a background gas having no absorption band in the wavelength emitted by the plasma is introduced in the discharge area.

* * * * *